US007146985B1

(12) United States Patent
Harris

(10) Patent No.: US 7,146,985 B1
(45) Date of Patent: Dec. 12, 2006

(54) METHOD AND APPARATUS FOR A CURLING IRON SHIELD

(76) Inventor: Adelaide D Harris, 243 Vaughn St. Northwest, Fort Walton Beach, FL (US) 32548

( * ) Notice: Subject to any disclaimer, the term of this patent is extended or adjusted under 35 U.S.C. 154(b) by 180 days.

(21) Appl. No.: 10/852,622

(22) Filed: May 24, 2004

(51) Int. Cl.
*A45D 24/00* (2006.01)

(52) U.S. Cl. ..... 132/200

(58) Field of Classification Search ..... 132/319, 132/200; 2/9, 206, 174, 12, 209, 171; D28/9, D28/10

See application file for complete search history.

(56) References Cited

U.S. PATENT DOCUMENTS 2,159,435 A * 5/1939 Gribbin ..... 2/174
2,296,078 A * 9/1942 Young ..... 2/174
3,963,034 A * 6/1976 Runberg et al. ..... 132/212
4,396,027 A * 8/1983 Loewenstine ..... 132/212
5,023,954 A * 6/1991 Lyons ..... 2/174
6,298,493 B1 * 10/2001 Ambroise ..... 2/209
6,505,633 B1 * 1/2003 Mosely ..... 132/319
6,708,347 B1 * 3/2004 Brundidge ..... 2/174

* cited by examiner

*Primary Examiner*—John J. Wilson
*Assistant Examiner*—Robyn Doan
(74) *Attorney, Agent, or Firm*—Michael I Kroll

(57) ABSTRACT

An apparatus and method for a curling iron shield 12. The curling iron shield 10 is comprised of a planar shield formed from a pliable material having a body 12 with a straight edge 16 and a built-in handle 14. The curling iron shield 12 can be placed against the scalp with the edge 16 engaging a lock of hair 24 that has been wound around a curling iron 18, 20, 22 wherein the body 12 of the shield may protect the user from engagement with the curling iron by positioning the shield between the scalp and the curling iron whereby the curling iron is wound toward the scalp and will engage the shield instead of the scalp.

4 Claims, 9 Drawing Sheets

METHOD AND APPARATUS FOR A CURLING IRON SHIELD

BACKGROUND OF THE INVENTION

1. Field of the Invention

The present invention relates generally to hair care products and, more specifically, to a curling iron shield. The curling iron shield is comprised of a planar shield formed from a pliable material having a body with a straight edge and a built-in handle. The curling iron shield can be placed against the scalp with the edge engaging a lock of hair that has been wound around a curling iron wherein the body of the shield may protect the user from engagement with the curling iron by positioning the shield between the scalp and the curling iron thereby as the curling iron is wound toward the scalp it will engage the shield instead of the scalp.

2. Description of the Prior Art

There is other hair product device designed for protecting the body of the user. Typical of these is U.S. Pat. No. 1,492,196 issued to Bergstrom on Apr. 29, 1924.

Another patent was issued to Cutrona, Jr. on Jul. 3, 1962 as U.S. Pat. No. 3,041,624. Yet another U.S. Pat. No. 3,328,806 was issued to Allegro on Jul. 4, 1967 and still yet another was issued on Nov. 20, 1973 to Alosi, et al. as U.S. Pat. No. 3,772,707.

Another patent was issued to Loewenstine on Aug. 2, 1983 as U.S. Pat. No. 4,396,027. Yet another U.S. Pat. No. 4,837,861 was issued to Cole on Jun. 13, 1989. Another was issued to Varney on Oct. 20, 1998 as U.S. Pat. No. 5,822,801 and still yet another was issued on Aug. 25, 1998 to Morlett as U.S. Pat. No. 5,797,141.

Another patent was issued to Schaaf on May 31, 1990 as German Patent No. DE3920996. Yet another Canadian Patent No. 2,109,500 was issued to Williams on Nov. 5, 1993. Another was issued to Evans on Dec. 28, 2000 as WIPO Publication No. WO 00/78167 and still yet another was issued on Oct. 25, 2001 to Mosely as WIPO Publication No. WO 01/76552.

U.S. Pat. No. 1,492,196

Inventor: Eleanor Bergstrom

Issued: Apr. 29, 1924

A toilet article including a shield to prevent contact of powder with the person of the user during application of the powder to the face, said shield comprising a wire frame an intermediate portion of which is provided with a concave curve to conform to the shape of the neck, a cover for the frame, shoulder shielding portions on the opposite sides of the curved portions, and a handle for supporting the frame.

U.S. Pat. No. 3,041,624

Inventor: Joseph J. Cutrona, Jr.

Issued: Jul. 3, 1962

A device of the class described comprising: a sheet of thin stiff imperforate waterproof material adapted to be bowed outwardly to a desired configuration, said sheet having opposed lateral side edges and a top and bottom portion; shaping means for maintaining said sheet bent to said outwardly bowed configuration, said shaping means comprising an elongated strip of malleable, form-retaining material secured to said sheet and extending substantially laterally thereof along a major portion of the face of said sheet.

U.S. Pat. No. 3,328,806

Inventor: Josephine Allegro

Issued: Jul. 4, 1967

A face and neck protector constructed of a generally resilient plastic material, or the like, comprising a forehead and face protector consisting of a sheet of said material generally convexly contoured to contact the face about the forehead and having extensions that are adapted to proceed below the hairline to and about the ears, a mounting portion extending centrally and below the protector and having an otherwise generally narrow dimension, a hollow cylindrical tube of said material having a slot along a portion thereof and retaining the mounting portion of said face and forehead protector, and a neck protector consisting of a sheet of said material and generally concavely contoured to contact the back of the neck and having extensions that are adapted to proceed about the ears, said convexly contoured portion adapted to receive portions of the face, said neck protector also having a mounting portion extending centrally and below the protector and having also an otherwise generally narrow dimension, and a button adapted to be disposed at a point of the mounting portion of the neck protector, said button being adapted to slide along the length of said slot for moving said neck protector into operative position.

U.S. Pat. No. 3,772,707

Inventor: Michael Alosi, et al.

Issued: Nov. 20, 1973

A protective shield assembly comprising a sheet of normally planar resilient flexible material curved to define a facial shield and having an upper edge adapted to approximately engage the hairline areas of a user, a bottom edge underlying and generally parallel to said upper edge, and oppositely disposed side portions terminating at free side edges extending between said upper edge and said bottom edge, and a support handle normally extending below said bottom edge during use, said support handle being of bifurcated, flexible construction and including a pair of spaced, oppositely disposed elongated hand grip portions and a medial portion interconnecting said hand grip portions, said medial portion being substantially spaced from said facial shield with said hand grip portions lying between said medial portion and said facial shield, means connected to said handle and said facial shield and extending for some length along said oppositely disposed side portions for the flexing of said facial shield to adjust the dimension between said side edges and the curvature of said upper edge for approximate engagement thereof with the hairline areas to prevent excessive exposure of a user's facial area to a spray.

U.S. Pat. No. 4,396,027

Inventor: Michael M. Lowenstine

Issued: Aug. 2, 1983

A hand held spray shield of an optically transparent material to protect the user's face, eyes, ear, and the like when the user is applying a cosmetic hair spray and any over-spray collecting on the surface of the shield will not run-off onto the hands of the user. The shield is of a form which includes a major shield portion and an ear shield portion separated by a notch configured and dimensioned to permit the hair in the temple area to be readily sprayed. The shield portions of the device typically include a frame having a cross-sectional configuration capable of forming, in conjunction with the adjacent shield portion, a trough-like zone for collecting spray.

U.S. Pat. No. 4,837,861

Inventor: Evelyn Cole

Issued: Jun. 13, 1989

A facial guard to protect the user's eyes, ears, and face from hair spray and the like, said guard manufactured from durable plastic, said plastic attainable in a variety of colors and molded into a thin, cup-shaped, paddle-like guard, and said guard having a reflector-type mirror, said mirror being congruent to said guard, and said mirror attached to the underneath, concaved side of said guard, said attachment being by means of gluing. The guard is shaped to be congruous to said user's hairline. The guard's said mirror is for use by said user as a cosmetic aide.

U.S. Pat. No. 5,822,801

Inventor: Marna L. Varney

Issued: Oct. 20, 1998

In accordance with the present invention, there is provided a face shield/fan for protecting a user's face against spray and against spillage occurring at the user's forehead, for dissipating odors and heat and for facilitating drying, the face shield/fan is provided with a mask. The mask is generally formed to receive a user's face and is provided with an upper portion and a lower portion. The upper portion is generally formed to correspond to the user's forehead. The face shield/fan is further provided with a sealing member which is attachable to the upper portion of the mask. The sealing member is generally formed to conform to the contours of the user's forehead for sealing therewith, for directing spillage occurring at the user's forehead away from the user's face. The face shield/fan is further provided with a handle. The handle is disposable adjacent to the lower portion of the mask and is used for manually supporting the face shield/fan against the user's forehead and for facilitating waving of the face shield/fan to dissipate odors and heat and facilitate drying.

U.S. Pat. No. 5,797,141

Inventor: Oscar L. Moriett

Issued: Aug. 25, 1998

A face shield having a face portion made of a rigid transparent material and having a concave shape so as to conform to the shape of a face. A handle portion is integrally formed with the face portion and extends downward from the bottom of the face portion. The handle portion is hollow and has an open bottom end. A handle grip covers the handle portion and also has an open bottom end. A bottom plug is fit securely in the open bottom end of the handle grip. The bottom plug has an opening to allow air to pass through the handle portion and into the area of the face portion. A hook is provided on the bottom plug to allow the shield to be hung on a wall or other surface when not in use. The shield is used while applying sprayable hair products and keeps these products from contacting the face of the user.

German Patent Number DE3920996

Inventor: Marianne Schaaf

Issued: May 31, 1990

The face protector is for use while using a hair spray. It comprises a plastics washable mask with an overall length of 0.40 m and a width of 0.24 m. The plastic surface is oval to conform with the human face. The lower or chin end engages in a plastic handle 0.09 m in length.

Canadian Patent Number 2,109,500

Inventor: Chisa R. Williams

Issued: May 6, 1998

A transparent plastic face shield of novel variety, for use by hair dressers, and also for use at home; said shield worn by client while the hair cutting operation takes place in front of the face; said shield executed and made to fit snugly yet comfortably against the upper portion of the client's face, preventing hair cuttings from falling onto said face, and also simultaneously acting as a safety shield; said shield being transparent to allow cutting the forward combed hair to the exact proper length in relation to the client's eyebrows.

WIPO Publication Number WO 00/78167

Inventor: Elise Evans

Issued: Dec. 28, 2000

A heat shield protecting the face, forehead, ears, and neck and to promote medical safety for users of hooded hair dryers and other heated hair appliances. The shield includes a face shield holder being generally U-shaped in construction and adapted to form around the front and side of the user's face. The holder has a pair of retainer elements adapted for holding the face shield around said user's head. A face visor is attached to the face shield and generally extending downward to cover the user's face when said face shield holder is held around the user's head. A forehead protector shield also is attached to the face shield holder for shielding the user's forehead from air blown by said hooded hair dryer. A neck shield cape has a pair of handles for attaching in front of a user's neck and the ends of the cape rests on a user's shoulders or are attachable to the sides and rear of a hooded hair dryer.

WIPO Publication Number WO 01/78552

Inventor: Myra L. Mosely

Issued: Oct. 25, 2001

A system of components that cooperate to shield the exposed skin of the ears, forehead and neck against contact by a hot curling iron includes a head band, an ear piece, and neck shield. The ear pieces fit over the ears to both protect them and derive support for the system from them. The head band and neck shield attach to ear pieces and are made of a heat resistant fabric. The three components will not prevent burns in every case but can prevent or limit injury from the proximity of the hot curling iron and harm from the occasional, inadvertent touching of the iron.

While these protective devices may be suitable for the purposes for which they were designed, they would not be as suitable for the purposes of the present invention, as hereinafter described.

SUMMARY OF THE PRESENT INVENTION

The present invention discloses a method and apparatus for a curling iron shield. The curling iron shield is comprised of a planar shield formed from a pliable material having a body with a straight edge and a built-in handle. The curling iron shield can be placed against the scalp with the edge engaging a lock of hair that has been wound around a curling iron wherein the body of the shield may protect the user from engagement with the curling iron by positioning the shield between the scalp and the curling iron whereby the curling iron is wound toward the scalp and will engage the shield instead of the scalp.

A primary object of the present invention is to provide a curling iron shield for use with a curling iron.

Another object of the present invention is to provide a curling iron shield that forms a barrier between the scalp and a curling iron.

Yet another object of the present invention is to provide a curling iron shield that is pliable.

Still yet another object of the present invention is to provide a curling iron shield Another object of the present invention is to provide a curling iron shield formed from a planar sheet.

Yet another object of the present invention is to provide a curling iron shield having a built-in handle.

Still yet another object of the present invention is to provide a curling iron shield having a body with a straight edge for placing said edge against a lock of hair while said curling iron engages the body of said shield.

Additional objects of the present invention will appear as the description proceeds.

The present invention overcomes the shortcomings of the prior art by providing a curling iron shield comprised of a planar shield formed from a pliable material having a body with a straight edge and a built-in handle. The curling iron shield can be placed against the scalp with the edge engaging a lock of hair that has been wound around a curling iron wherein the body of the shield may protect the user from engagement with the curling iron by positioning said shield between the scalp and said curling iron.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
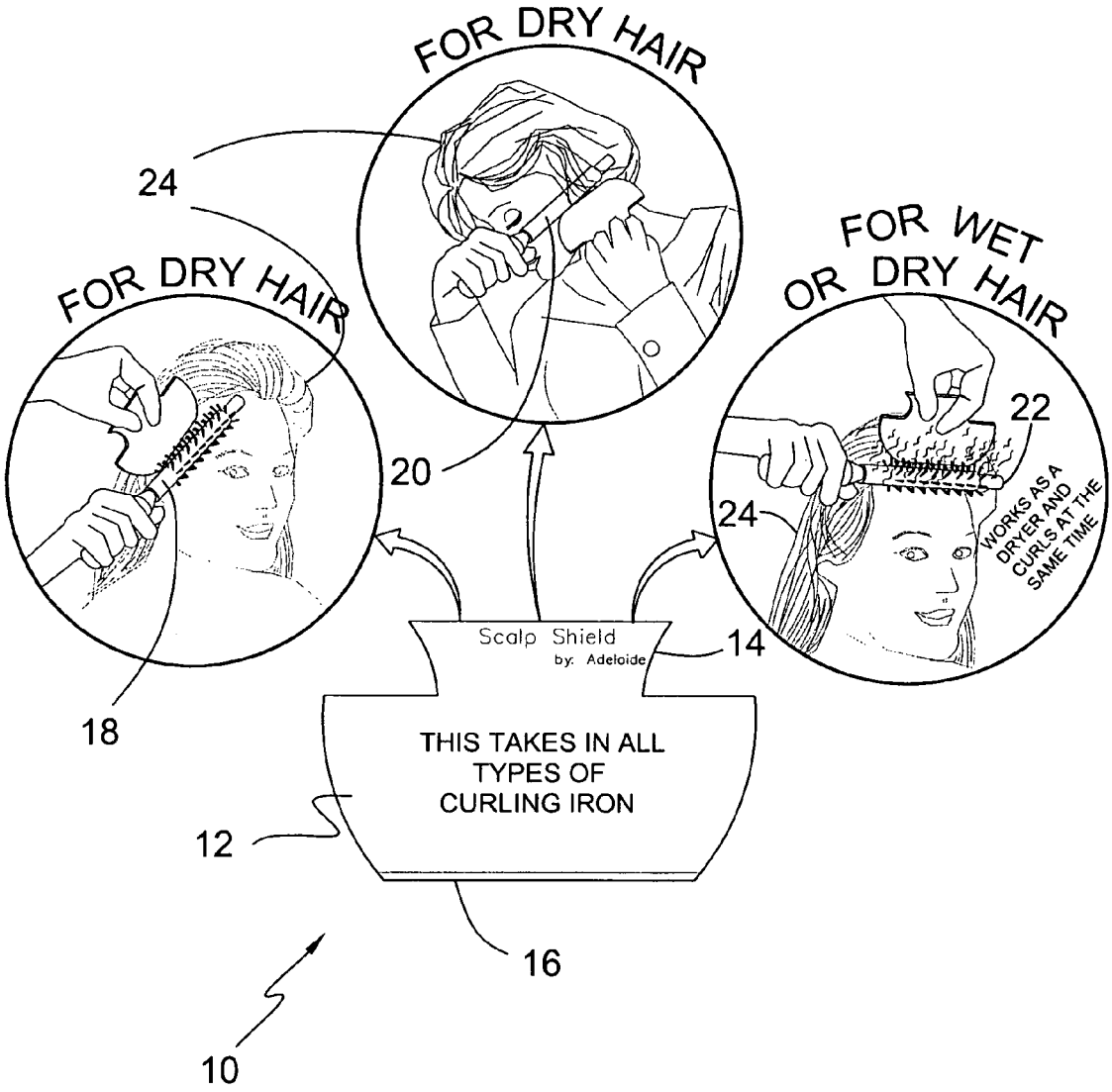
FIG. 1 is an illustrative view of the present invention in use.

With regard to reference numerals used, the following numbering is used throughout the drawings.

10 present invention
12 shield body
14 handle
16 straight edge
18 curling iron with brush
20 metal curling iron
22 curling iron with heat blower
24 hair
26 user
28 hand
30 deformed portion
32 deformed portion

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 has a pliable planar shield portion 12 with a built-in handle portion 14 having a body with a straight edge 16 for engaging the base of a lock of hair against the scalp whereby a curling iron 18, 20, 22 engaging the distal end of the lock of hair 24 and rotatively manipulated will engage the shield 12 positioned between the scalp and curling iron or other heat treatment hair care product. Shown are a curling iron with brush for dry hair 18, a metal curling iron 20 for dry hair and a curling iron with a heat blower 22 for wet or dry hair.

Figure 2:
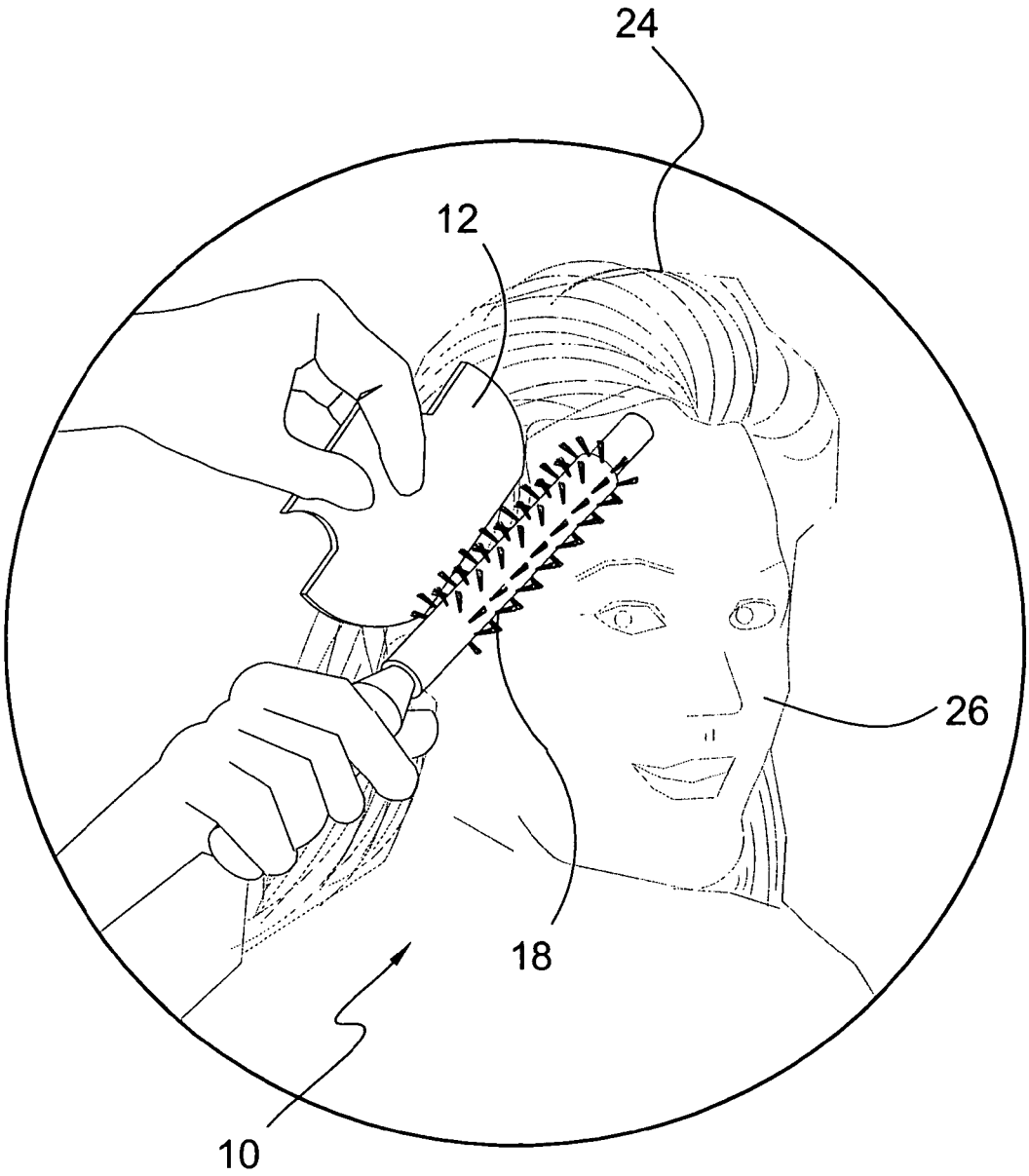
FIG. 2 is an illustrative view of the present invention in use.

Turning to FIG. 2, shown therein is an illustrative view of the present invention 10 in use. Shown is a hair care product 18 having means for engaging and winding the hair 24 around the engagement member while heat is used to treat said hair. The use of these products, i.e., curling irons, can cause the user 26 discomfort and possible injury when these products engage the scalp. The present invention 10 forms a heat tolerant pliable shield 12 that can be placed between the scalp and the heat generating hair care product 18 to prevent the product from contacting the scalp.

Figure 3:
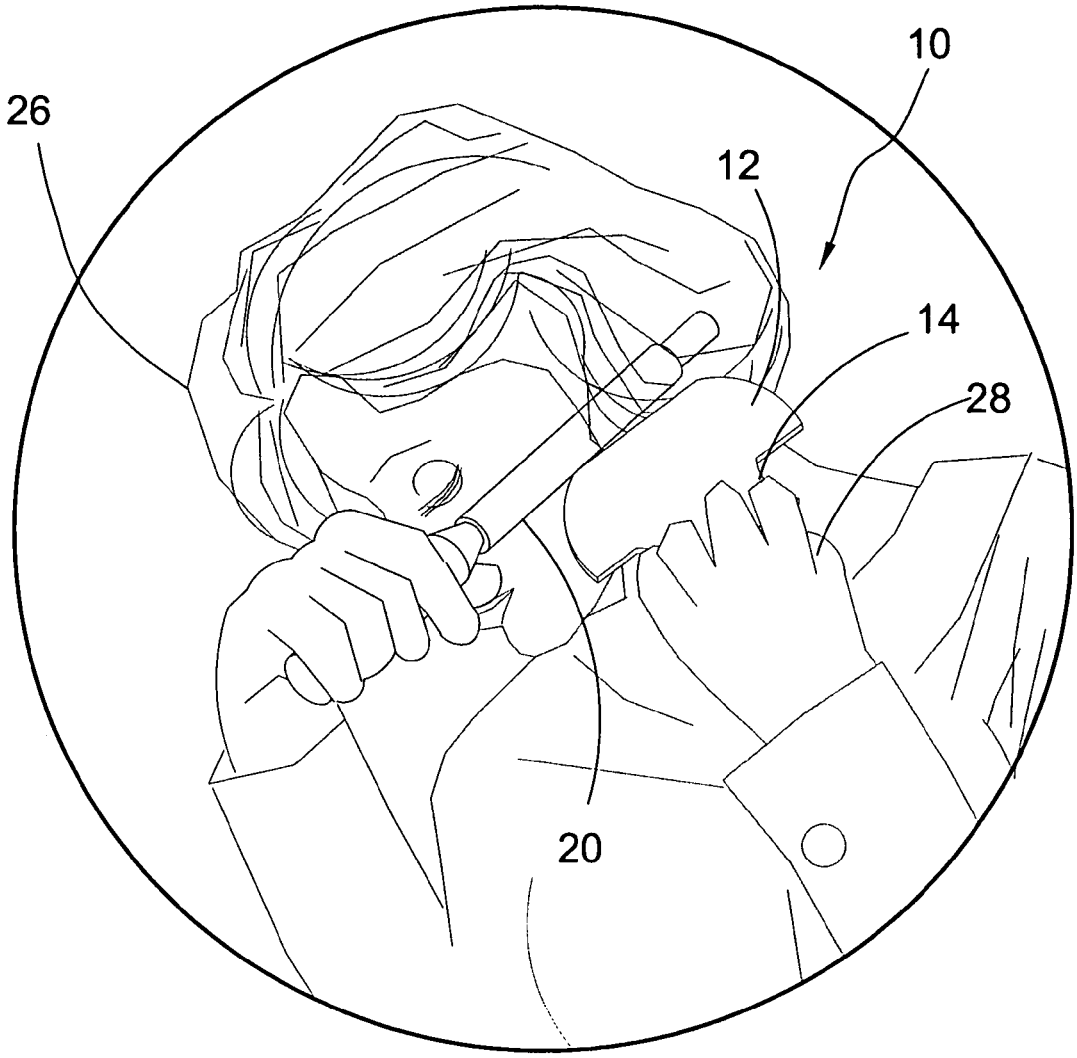
FIG. 3 is an illustrative view of the present invention in use.

Turning to FIG. 3, shown therein is an illustrative view of the present invention 10 in use. The present invention 10 comprises a heat tolerant planar material having a built-in handle 14 for being grasped by the hand 28 of a user and allows the user to easily position the shield 12 using the handle to any desired angle and can be used to cover the ears while using heat generating hair care products 20.

Figure 4:
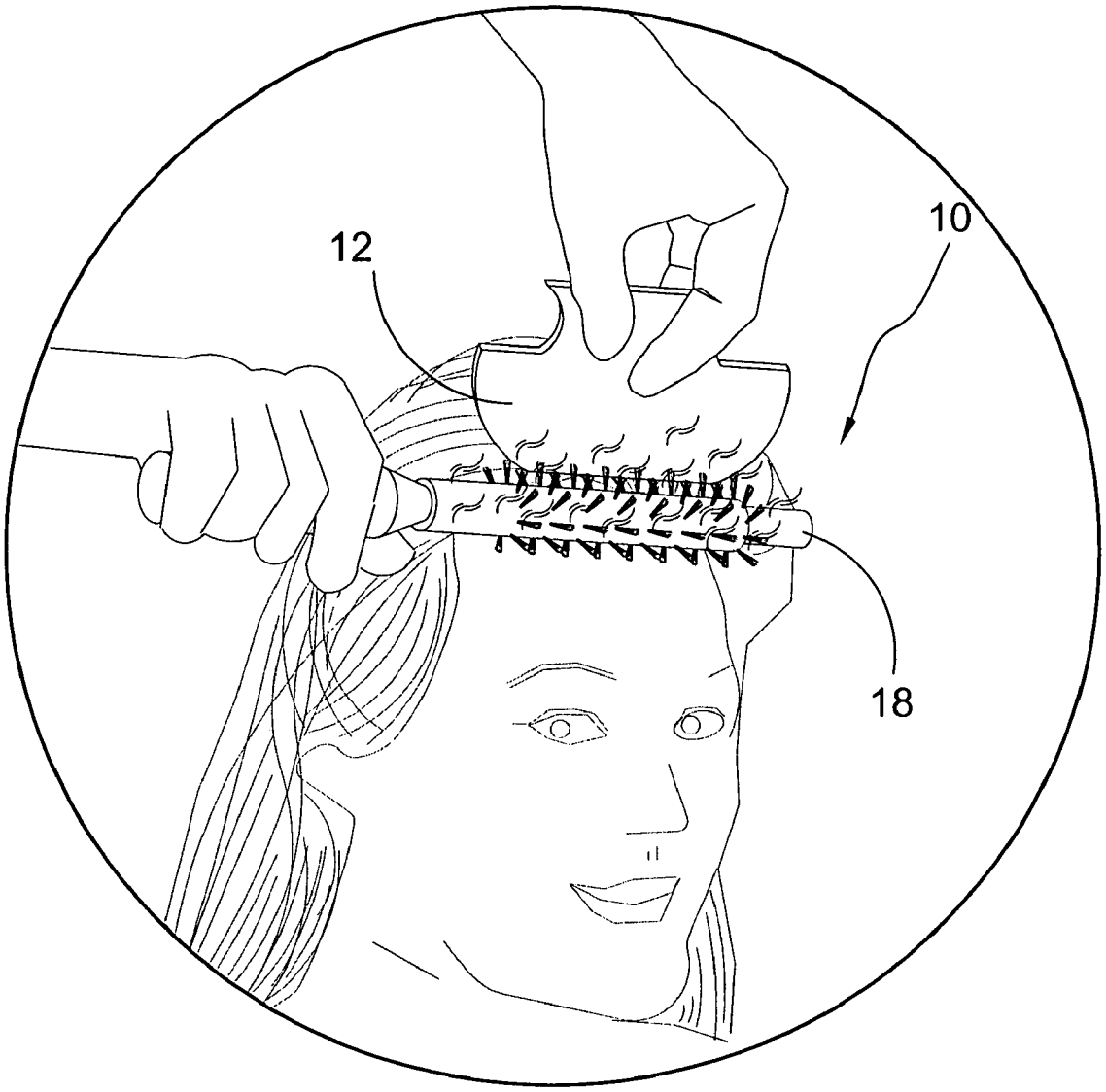
FIG. 4 is an illustrative view of the present invention in use.

Turning to FIG. 4, shown therein is an illustrative view of the present invention 10 in use. Shown is another illustration wherein the shield 12 can be easily positioned against the scalp whereby heat generating hair care products 18 will engage the shield instead of the user's scalp.

Figure 5:
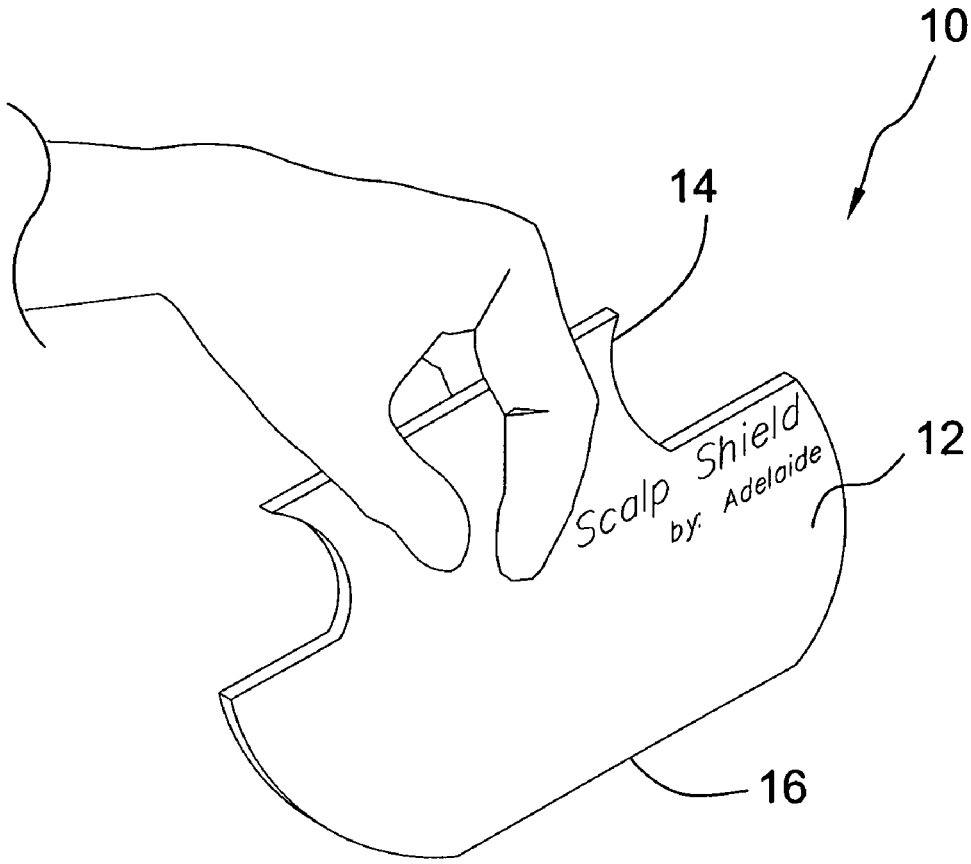
FIG. 5 is an illustrative view of the present invention.

Turning to FIG. 5, shown therein is an illustrative view of the present invention 10. Shown is the present invention 10 being comprised of a planar heat tolerant pliable material having a body with shield 12 and a built-in handle 14. The body 12 has a straight edge 16 opposed to the handle 14 and formed of a pliable material that can be fashioned during use into a somewhat concave shape to receive heat generating hair care products, such as a curling iron.

Figure 6:
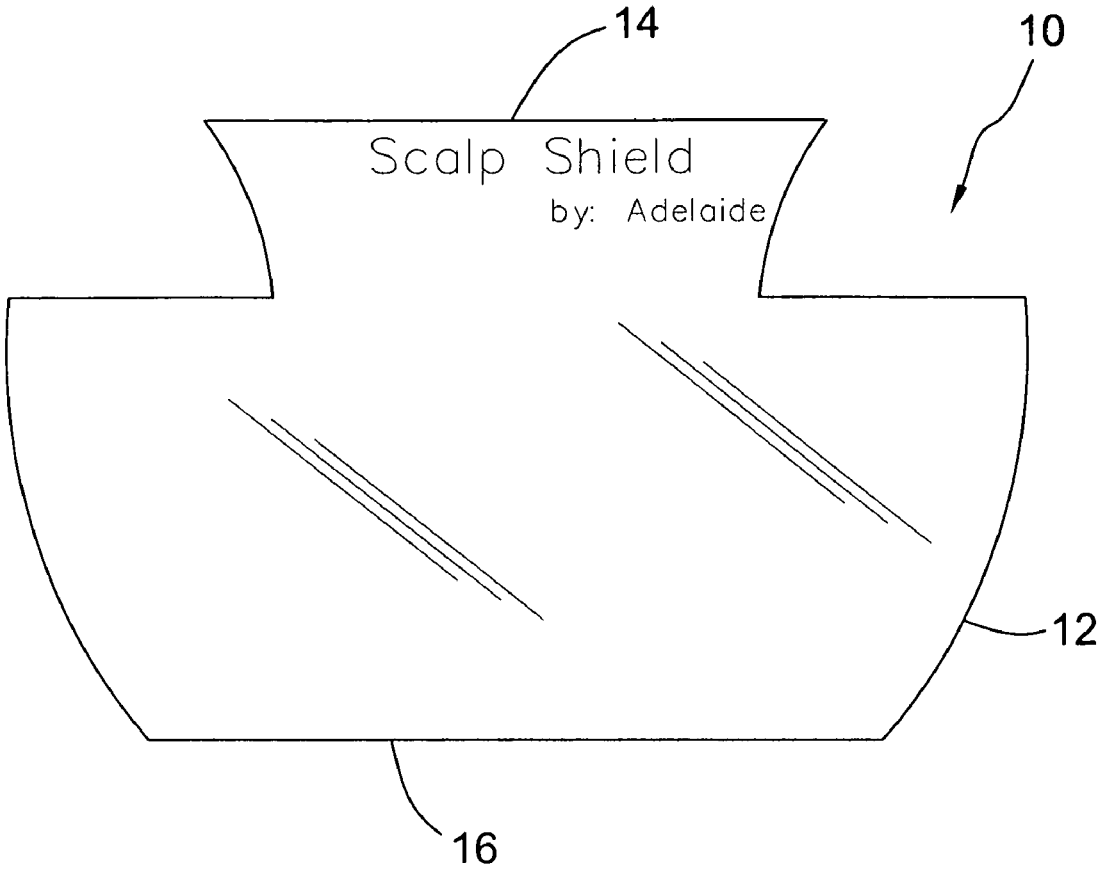
FIG. 6 is a frontal view of the present invention.

Turning to FIG. 6, shown therein is a frontal view of the present invention 10. Shown is a front view of the heat tolerant pliable shield 12 having a built-in handle 14 and opposing straight edge 16 that is used to prevent contact between a heat generating hair care product and a user's scalp.

Figure 7:
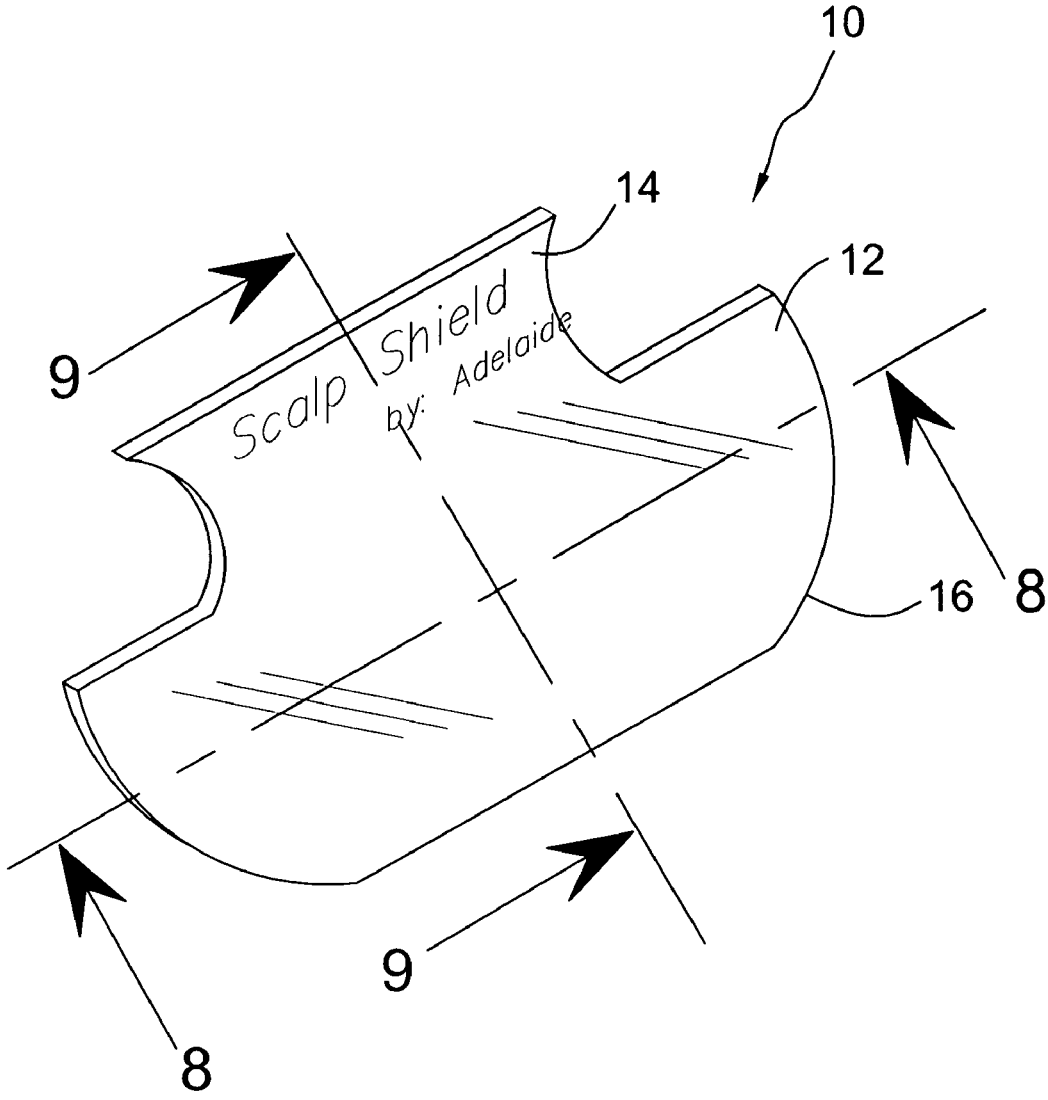
FIG. 7 is a perspective view of the present invention.

Turning to FIG. 7, shown therein is a perspective view of the present invention 10. Shown is a perspective view of the heat tolerant pliable shield 12 having a built-in handle 14 and opposing straight edge 16 that is used to prevent contact between a heat generating hair care product and a user's scalp. The device 10 is easily manipulated to any desired angle and can be flipped over having the same properties regardless of which side is used.

Figure 8:
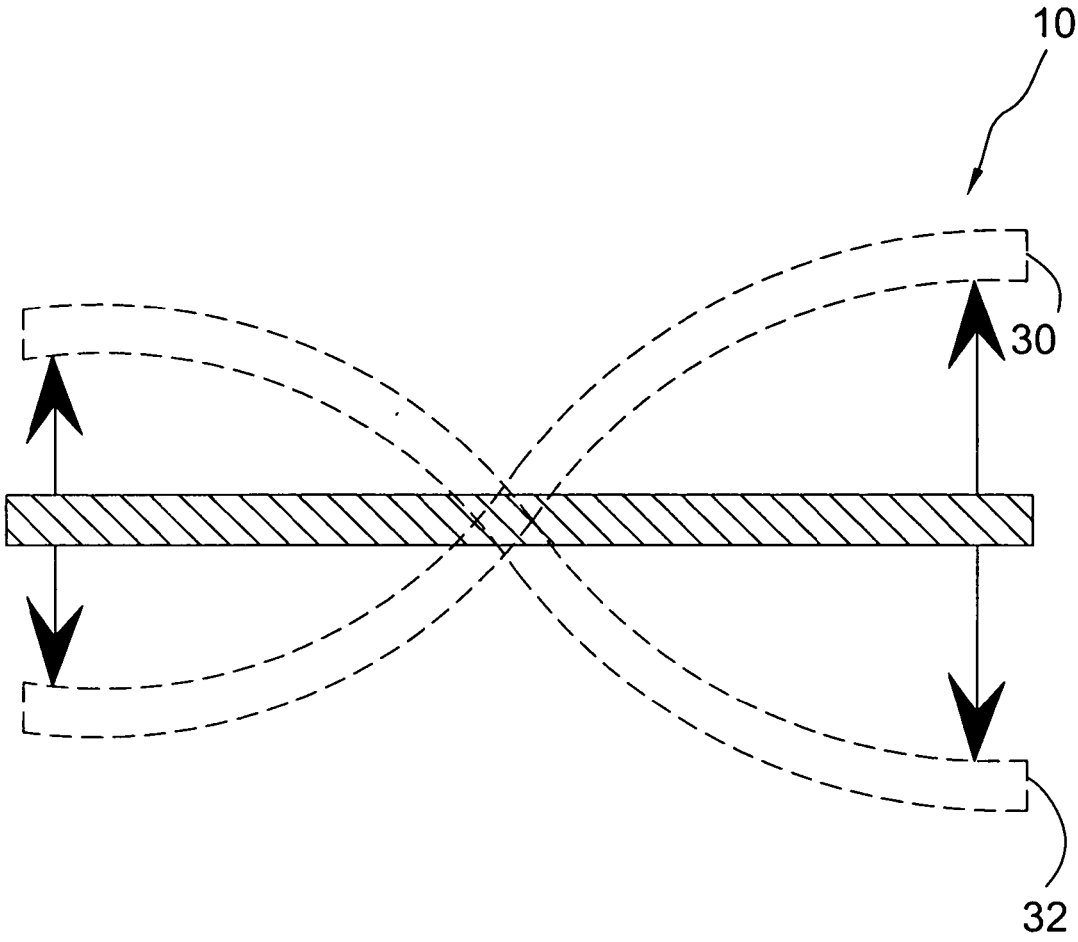
FIG. 8 is a perspective view of the present invention.

Turning to FIG. 8, shown therein is a perspective view of the present invention 10. Shown is a cross sectional view taken from FIG. 7 as indicated wherein the heat tolerant pliable material can be temporarily deformed at 30, 32 by the user to a desired shape, such as for receiving a heat generating hair care products like curling irons.

Figure 9:
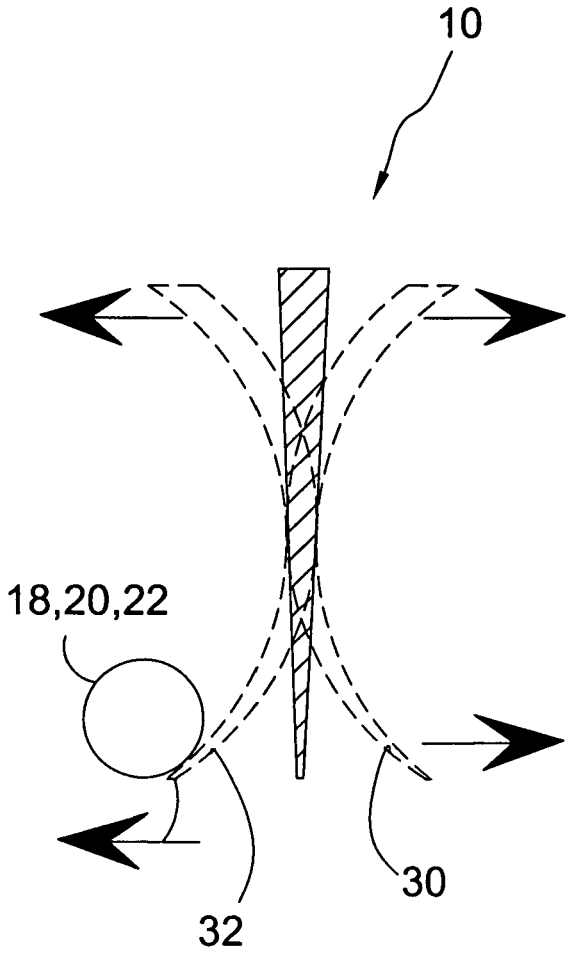
FIG. 9 is a perspective view of the present invention.

Turning to FIG. 9, shown therein is a perspective view of the present invention 10. Shown is a cross sectional view taken from FIG. 7 as indicated wherein the heat tolerant pliable material can be temporarily deformed at 30, 32 by the user to a desired shape, such as for receiving a heat generating hair care products like curling irons 18,20,22.

I claim:

1. A method for protecting the scalp of a user from getting burned by a curling iron, comprising the steps of:

a) forming a planar member having a first and second opposing end and a pair of opposing sides;

b) forming a handle on the first end of the planar member to permit the shield to be grasped by a user;

c) forming a straight edge on the second end of the planar member;

d) forming the planar member of heat resisted material to permit the shield to be used with a curling iron; and e) forming the planar member of pliable material to permit the planar member to be deformed into a concave shape; and g) placing the straight edge between a curling iron and the scalp of a user; and g) placing the curling iron at least partially within the concave portion of the planar member.

2. The method of claim 1, further comprising the step of using the shield with a curling iron having a brush thereon.

3. The method of claim 1, further comprising the step of using the shield with a metal curling iron.

4. The method of claim 1, further comprising the step of using the shield with a curling iron having a heat blower thereon.

* * * * *